US005143172A

United States Patent [19]

Rhoads

[11] Patent Number: 5,143,172

[45] Date of Patent: Sep. 1, 1992

[54] SLIDE AND SEEK FIRE ESCAPE

[76] Inventor: Ward E. Rhoads, 711 Palmwood St., Delta, Ohio 43515

[21] Appl. No.: 737,070

[22] Filed: Jul. 29, 1991

[51] Int. Cl.[5] ..... A62B 1/20

[52] U.S. Cl. ..... 182/100; 182/189

[58] Field of Search ..... 182/100, 189, 83, 48

[56] References Cited

U.S. PATENT DOCUMENTS

| | | | |
|---|---|---|---|
| 785,301 | 3/1905 | Fuger | 182/100 |
| 815,030 | 3/1906 | McKenna | 182/189 |
| 1,883,849 | 10/1932 | Vanasse | 182/100 |
| 3,848,698 | 11/1974 | Kanbe | 182/83 |
| 4,049,080 | 9/1977 | Suzuki | 182/48 |

*Primary Examiner*—Reinaldo P. Machado

*Attorney, Agent, or Firm*—Richard L. Miller

[57] ABSTRACT

A slide and seek fire escape is provided for a high rise building having a roof and multiple floors. The fire escape consists of a plurality of balconies stacked one above the other for the roof and each floor of the building, with the balconies having right and left staggered escape apertures. A pair of elongated slide poles are also provided. One slide pole extends through the balconies in the center of the right escape apertures, while the other slide pole extends through the balconies in the center of the left escape apertures. A person can exit the building during a fire by entering one balcony and slide down one slide pole to the next balcony and walk to the other slide pole and slide down, thereby repeating the slide until the person reaches ground level.

2 Claims, 1 Drawing Sheet

SLIDE AND SEEK FIRE ESCAPE

BACKGROUND OF THE INVENTION

The instant invention relates generally to escape devices and more specifically it relates to a slide and seek fire escape.

Numerous escape devices have been provided in the prior art that are adapted to allow people to evacuate areas that are in danger, such as in a fire or the like. For example, U.S. Pat. No. 3,315,762 to Torrey; U.S. Pat. No. 3,866,734 to Elkins et al; U.S. Pat. No. 3,973,645 to Dix et al; U.S. Pat. No. 4,018,321 to Fisher; U.S. Pat. No. 4,257,490 to Brady and Des. U.S. Pat. No. 293,476 to Morales all are illustrative of such prior art. While these units may be suitable for the particular purpose to which they address, they would not be as suitable for the purpose of the present invention as hereafter described.

A primary object of the present invention is to provide a slide and seek fire escape that will overcome the shortcomings of the prior art devices.

Another object is to provide a slide and seek fire escape that would give occupants of high rise buildings a great advantage of exiting any floor in a safer and quicker manner.

An additional object is to provide a slide and seek fire escape that consists of a staggered slide pole apparatus for use on many different types of buildings, such as condominiums, apartments, offices or motor inns where more than one story exists.

A further object is to provide a slide and seek fire escape that is simple and easy to use.

A still further object is to provide a slide and seek fire escape that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
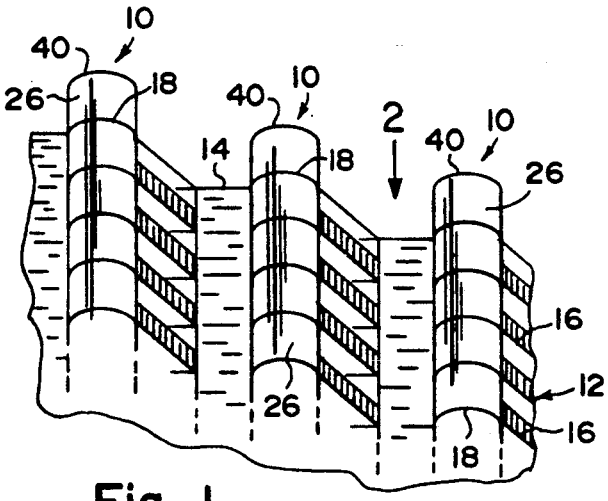
FIG. 1 is a diagrammatic partial perspective view of a building incorporating the instant invention.
Figure 2:
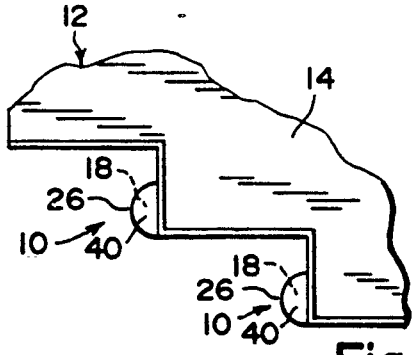
FIG. 2 is a top plan view taken in the direction of arrow 2 in FIG. 1, thereof.
Figure 3:
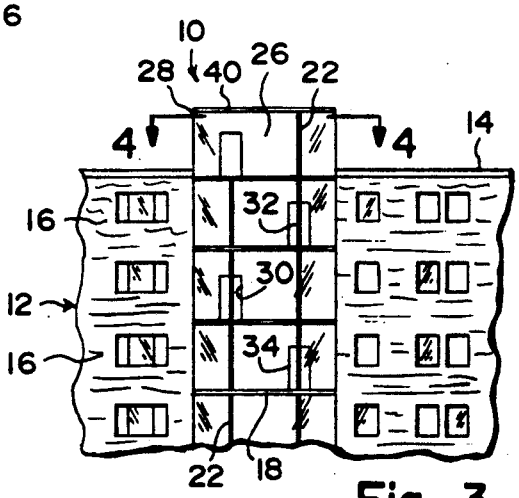
FIG. 3 is a diagrammatic elevational view of another building with the instant invention installed thereon.
Figure 5:
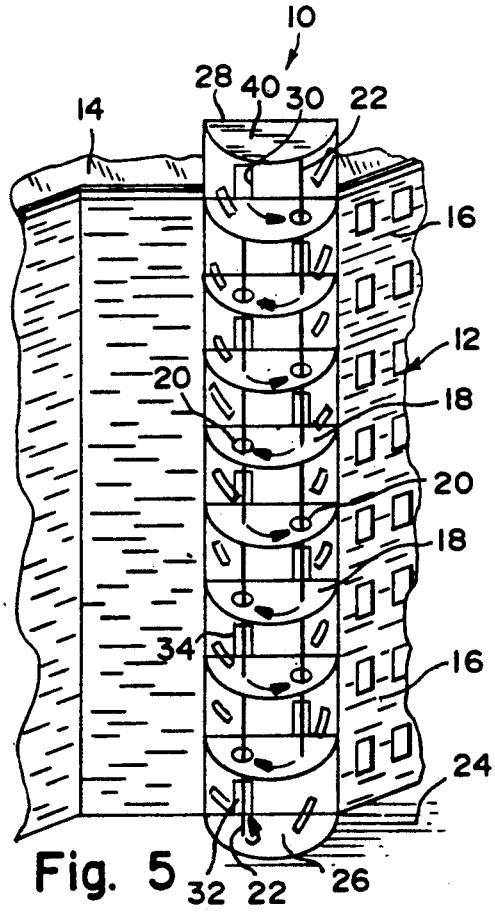
FIG. 5 is a diagrammatic partial perspective view of still another building showing the invention in greater detail installed thereon.
Figure 4:
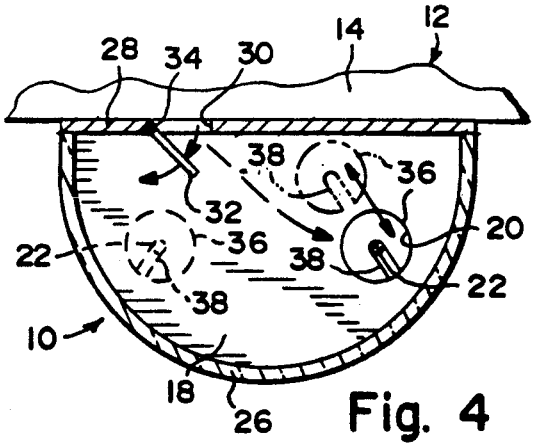
FIG. 4 is a cross sectional view taken along line 4—4 in FIG. 3.

Turning now descriptively to the drawings, in which similar reference characters denote similar elements throughout the several views, the Figures illustrate a slide and seek fire escape 10 for a high rise building 12 having a roof 14 and multiple floors 16. The fire escape

10 consists of a plurality of balconies 18 stacked one above the other, for the roof 14 and each floor 16 of the building 12, with said balconies 18 having right and left staggered escape aperture 20. A pair of elongated slide poles 22 are also provided. One slide pole 22 extends through the balconies 18 in the center of the right escape apertures 20 while the other slide pole 22 extends through the balconies 18 in the center of the left escape apertures 20 so that a person can exit the building during a fire by entering one of the balconies 18 and slide down one of the slide poles 22 to the next balcony 18 and walk to the other slide pole 22 and slide down, thereby repeating the slides until the person reaches ground level 24.

Each balcony 18 includes a transparent front enclosure 26 to reduce the fear of heights for the person when exiting the building 12 during the fire. The balcony 18 further includes a rear wall 28 having a doorway 30 positioned opposite from the escape aperture 20. A fire door 32 is hinged at 34 to one side of the doorway 30 in the rear wall 28 so that the person opening the fire door 32 when entering the balcony 18 has to walk over to one side to reach the slide pole 22 in the center of its respective escape aperture 20. Each balcony 18 can further include a cover plate 36 having a slot 38 extending to its center so that the cover plate 36 can slide and fit over the escape aperture 20 to prevent a person from accidentally falling into the escape aperture 20.

The uppermost balcony 18 at the roof 14 of the building 12 will also have a top covering 40 for protection from the weather. The lowest balcony 18 at the ground level 24 will not have the escape aperture 20, and need not also have a transparent front enclosure 26 so that a person can exit directly to the street or enter the fire door 30 to exit the building 12.

The instant invention 10 can be incorporated as part of original construction in new buildings or be construct as an add on to existing buildings where it is desired to upgrade the present fire escape system.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A slide and seek fire escape for a high rise building having a roof and multiple floors, said fire escape comprises:

a) a plurality of balconies sacked one above the other in one to one correspondence with the roof and each floor of the building, with alternate said balconies each having right and left staggered escape apertures respectively; and b) a pair of elongated slide poles in which a first of said slide pole extends through said balconies in the center of the right escape apertures, while a second slide pole extends through said balconies in the center of the left escape apertures, so that a person can exit the building during a fire by entering one said balcony and slide down the first slide pole to another said balcony and walk to the second slide pole and slide down, thereby repeating the slides until the person reaches ground level, wherein each said balcony includes:

i) a transparent front enclosure to reduce the fear of heights for the person when exiting the building during the fire;

ii) a rear wall having a doorway positioned in a location which is away and distant from the escape aperture; and iii) a fire door hinged to one side of the doorway in said rear wall so that the person opening said fire door when entering said balcony has to walk over to an opposite side of said balcony to reach the slide pole in the center of its respective escape aperture.

2. A slide and seek fire escape as recited in claim 1, wherein at least one said balcony further includes a cover plate having a slot extending to its center so that said cover plate can slide and fit over the escape aperture to prevent a person from accidentally falling into the escape aperture.

* * * * *